US008997422B1

(12) United States Patent
Kim

(10) Patent No.: US 8,997,422 B1
(45) Date of Patent: Apr. 7, 2015

(54) BUILDING CONSTRUCTION FORMED OF PREFAB CONCRETE FORMS

(71) Applicant: Daniel Kim, Los Angeles, CA (US)

(72) Inventor: Daniel Kim, Los Angeles, CA (US)

( * ) Notice: Subject to any disclaimer, the term of this patent is extended or adjusted under 35 U.S.C. 154(b) by 0 days.

(21) Appl. No.: 14/261,348

(22) Filed: Apr. 24, 2014

(51) Int. Cl.
*E04B 1/16* (2006.01)

(52) U.S. Cl.
CPC ..... *E04B 1/161* (2013.01); *E04B 1/167* (2013.01)

(58) Field of Classification Search
CPC ..... E04B 1/161; E04B 1/167
USPC ..... 52/422, 426, 439, 440, 442, 262, 267
See application file for complete search history.

(56) References Cited

U.S. PATENT DOCUMENTS

| | | | | | |
|---|---|---|---|---|---|
| 1,848,357 | A * | 3/1932 | Kotrbaty | 52/325 |
| 1,877,898 | A * | 9/1932 | Kotrbaty | 52/293.3 |
| 3,638,382 | A * | 2/1972 | Merrill | 52/359 |
| 3,932,973 | A * | 1/1976 | Moore | 52/216 |
| 4,472,919 | A * | 9/1984 | Nourse | 52/601 |
| 5,033,248 | A * | 7/1991 | Phillips | 52/742.14 |
| 5,335,472 | A * | 8/1994 | Phillips | 52/742.14 |
| 5,528,876 | A * | 6/1996 | Lu | 52/654.1 |
| 5,611,183 | A * | 3/1997 | Kim | 52/426 |
| 6,295,770 | B1 * | 10/2001 | Sheu et al. | 52/167.1 |
| 6,973,864 | B1 * | 12/2005 | Ahmad | 89/36.02 |
| 8,495,846 | B2 * | 7/2013 | Bravinski | 52/326 |
| 8,707,644 | B2 * | 4/2014 | Degen et al. | 52/309.12 |
| 2014/0245691 | A1 * | 9/2014 | Molinelli | 52/582.1 |

* cited by examiner

*Primary Examiner* — Michael Safavi
(74) *Attorney, Agent, or Firm* — John K. Park; Park Law Firm

(57) ABSTRACT

Prefab wall, column, ceiling concrete forms are provided. The wall or column concrete forms comprise a metal mesh portion, dented line portions, horizontal cut portions, edge-pole portions, and a foam or light concrete portion. The metal mesh portion is formed with a shape of three-sided vertical mesh frame, the metal mesh portion comprising front net and two side nets. The dented line portions are provided horizontally across a plurality of locations of the metal mesh portion. The horizontal cut portion is provided at an edge of the side nets and being configured to receive rebars. The edge-pole portion is provided vertically along an inner edge of the side nets. The foam or light concrete portion is disposed and hardened with the metal mesh portion and the plurality of dented line portion. The ceiling concrete form includes a base board, pyramidal trusses, and a longitudinal bar.

7 Claims, 11 Drawing Sheets

BUILDING CONSTRUCTION FORMED OF PREFAB CONCRETE FORMS

BACKGROUND OF THE INVENTION

The present invention relates to a constructing material, a prefab concrete forms for building construction. More particularly, this invention relates to a light cement wall, column, ceiling structure structures, which are strong and light, and can be used to construct high building conveniently.

Accordingly, a need for construction of buildings has been present for a long time considering the expansive demands in the everyday life. This invention is directed to solve these problems and satisfy the long-felt need.

SUMMARY OF THE INVENTION

The present invention contrives to solve the disadvantages of the prior art.

An object of the invention is to provide wall and ceiling structures for buildings.

Another object of the invention is to provide a method for constructing wall and ceiling structures.

An aspect of the invention provides a prefab wall, which comprises a metal mesh portion, a plurality of dented line portions, a plurality of horizontal cut portions, two edge-pole portions, and a foam or light concrete portion.

The metal mesh portion is formed with a shape of three-sided vertical mesh frame, the metal mesh portion comprising front net and two side nets.

The plurality of dented line portions are provided horizontally across a plurality of locations of the metal mesh portion.

Each of the plurality of horizontal cut portions is provided at an edge of the side nets and being configured to receive one or more rebars.

Each of the two edge-pole portions is provided vertically along an inner edge of the side nets of the metal mesh portion.

The foam or light concrete portion is disposed and hardened with the metal mesh portion and the plurality of dented line portion.

The wall is configured to be adjoined with another wall by engaging through the side nets by a plurality of mechanical fasteners.

Each of the two edge-pole portions may comprise a wooden angular pole.

Each of the two edge-pole portions may be fixed to the inner edge of the side nets of the metal mesh portion.

The wall may be adapted to be disposed leaning to and fixed to a dry wall.

The metal mesh portion may further comprise two extending portion from the edges of the side net, so as to wrap a side of the edge-pole portions.

The wall may further comprise a plurality of horizontal bolstering L-shaped metal bars, each of which being queued through the side nets at a location close to the front net.

Another aspect of the invention provides a column concrete form, comprising a metal mesh portion, a plurality of horizontal cut portions, four edge-pole portions, and a plurality of horizontal fixing groove portions.

The metal mesh portion is formed with a shape of three-sided vertical mesh frame, the metal mesh portion comprising front net and two side nets, each of which meeting the front net at two bent edges.

Each of the plurality of horizontal cut portions is provided at an edge of the side nets and being configured to receive one or more rebars.

Each of the four edge-pole portions is provided vertically along an inner edge of the side nets of the metal mesh portion or the two bent edges.

The plurality of horizontal fixing groove portions are buried in a first external concrete wall horizontally, and each of the plurality of horizontal fixing groove portions comprises an opening, a wedge-shaped gap, and a holding material inserted through the wedge-shaped gap. And, each of the plurality of horizontal fixing groove portions is configured to fix the column to the first external concrete wall by a plurality of screws, each of which is applied from an inner surface of the metal mesh portion to the opening and the holding material of the wedge-shaped gap in the first external concrete wall contacting an outer surface of the front net of the metal mesh portion.

The holding material in the wedge-shaped gap may be made of plastic and adapted to receive and hold the screw.

The holding material in the wedge-shaped gap may be provided in an elongated form, and the holding material comprises an elongated slit configured to guide and prevent the screw from slip away while screwing.

Each of the plurality of horizontal fixing groove portions may be made of metal.

Each of the four edge-pole portions may comprise a wooden angular pole fixed to the metal mesh portion with mechanical fasteners.

The mechanical fasteners may comprise nails, screws, or wires.

Each of the four edge-pole portions may comprise an L-shaped metal pole.

The L-shaped metal pole may comprise a plurality of elongated through-holes for screws connecting itself to the metal mesh portions.

The column may further comprise a plurality of wall-bolstering fasteners for holding together and bolstering the first external wall and a second external wall sandwiching the column with the first external wall.

Each of the wall-bolstering fasteners may comprises a connecting tube, a first screw, a second screw, and two funnel portions.

The connecting tube has a master female thread on an inner surface thereof.

The first screw has a detachable screw head buried in the first external wall and a detachable screw body, and the detachable screw head comprises a female thread through a hole disposed therein and a plurality of catching vanes and the detachable screw body comprises a first male thread configured to engage the female thread of the detachable screw head and a second male thread configured to engage the master female thread of the connecting tube.

The second screw has a fixed head and a fixed body, and the fixed body comprises a male thread configured to engage the master female thread of the connecting tube.

The two funnel portions are disposed at both ends of the connecting tube, wherein each of the funnel portions is configured to guide the first and second screws into the connecting tube.

Each of the wall-bolstering fasteners is disposed between the first and second external concrete walls.

The second screw engages the connecting tube through the second external concrete wall.

Still another aspect of the invention provides a ceiling concrete form, comprising an elongated metal base board, a plurality of pyramidal trusses, and a longitudinal bar.

The elongated metal base board includes two raised edges.

Each of the plurality of pyramidal trusses comprises four edge bars connecting a portion of two raised edges of the elongated metal base board with a pyramidal point where the four edge bars meet and engage one another securely.

The longitudinal bar is disposed so as to connect all pyramidal points of the plurality of pyramidal trusses.

The ceiling concrete form may be configured to be disposed next to another ceiling concrete form and each of the ceiling concrete forms is fixed detachably on an external bottom board, so that concrete is poured on the adjoined array of the ceiling concrete forms.

The advantages of the present invention are: (1) the prefab wall or column structures according to the invention are easy and cheap to manufacture and construct buildings with; and (2) the ceiling structures provides a convenient way of constructing ceiling with concrete.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Figure 1:
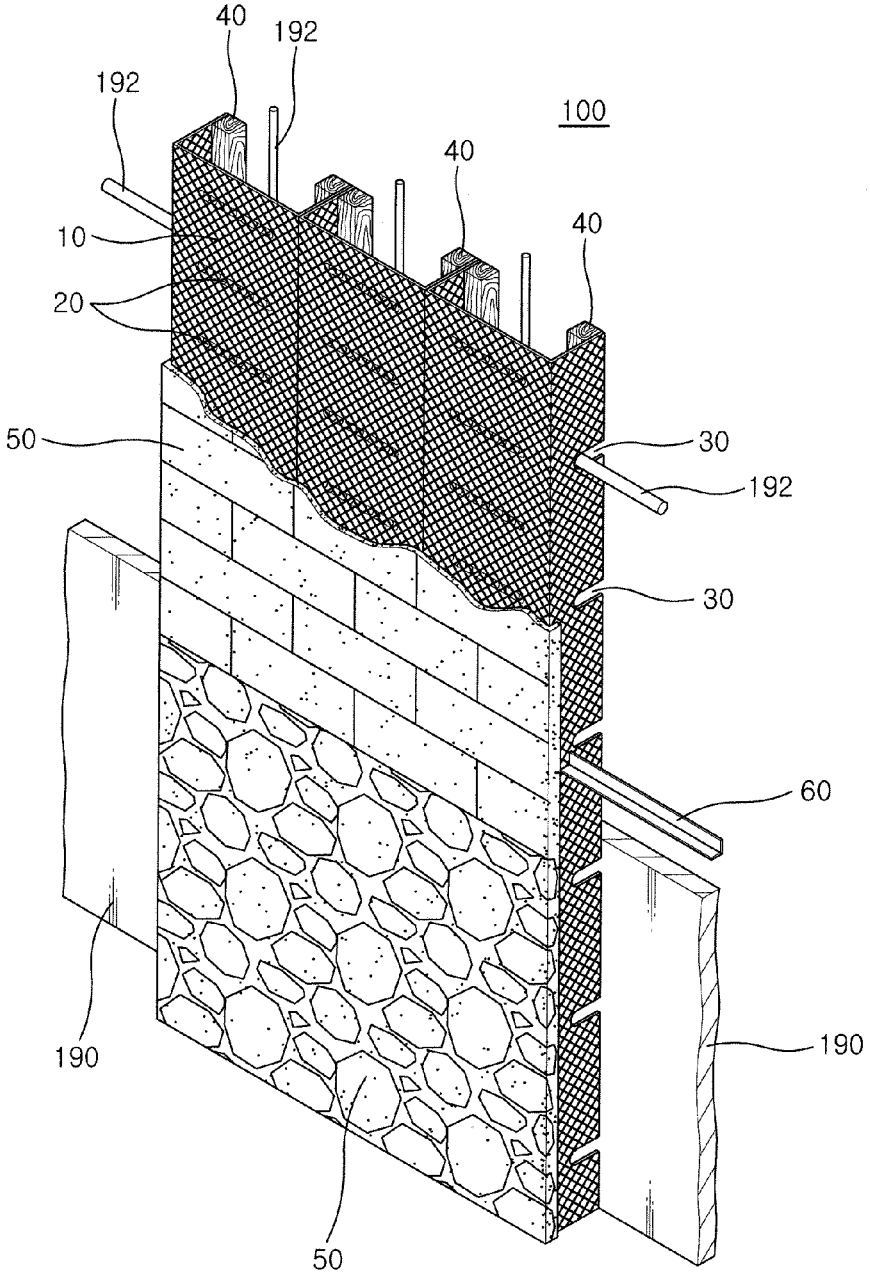
FIG. 1 is a perspective view showing a prefab wall partially built according to an embodiment of the present invention.
Figure 2:
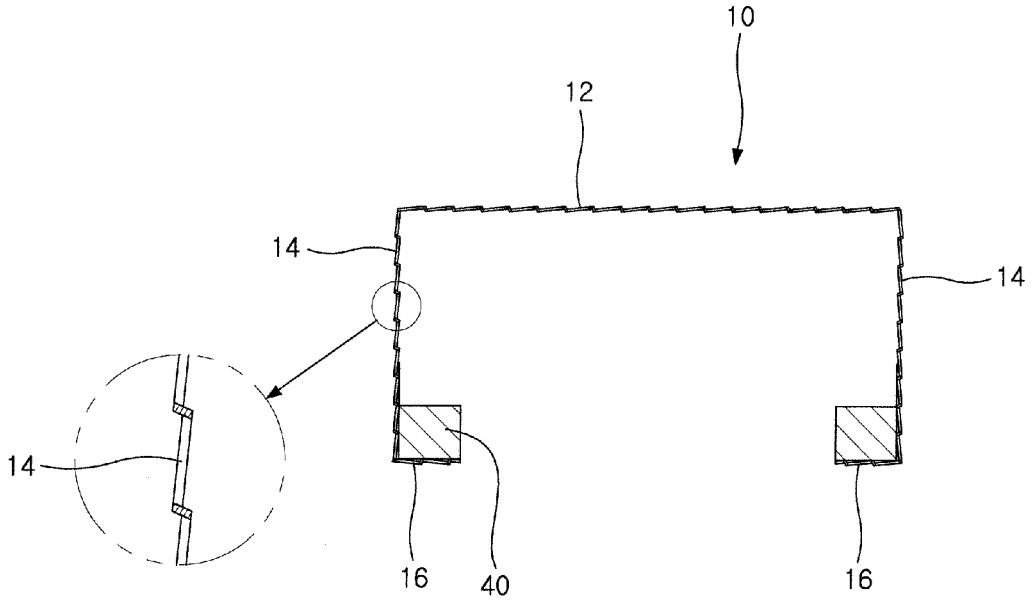
FIG. 2 is a cross-sectional view showing a metal mesh portion of the prefab wall of FIG. 1.
Figure 3:
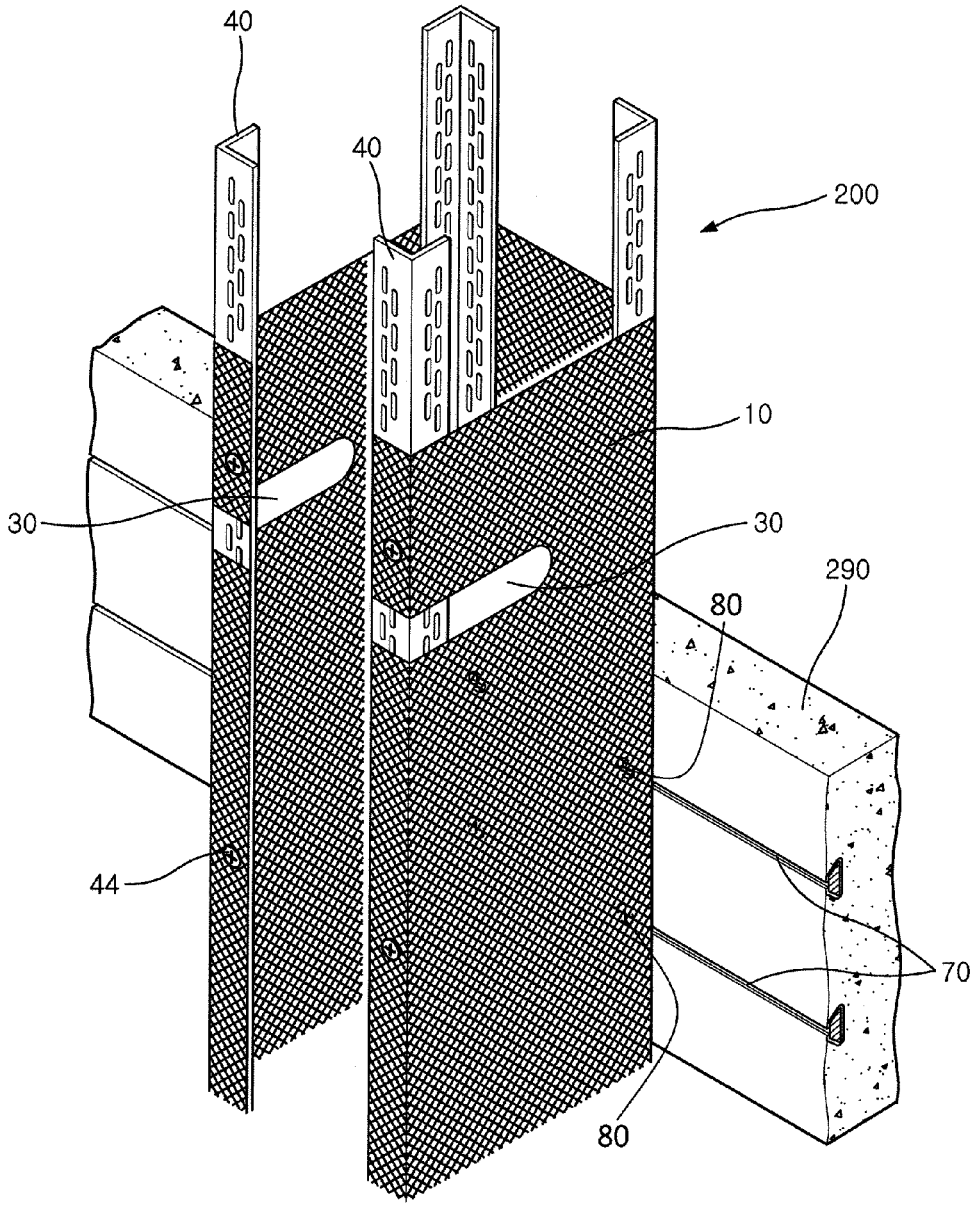
FIG. 3 is a perspective view showing a column concrete form according to an embodiment of the present invention.
Figure 10:
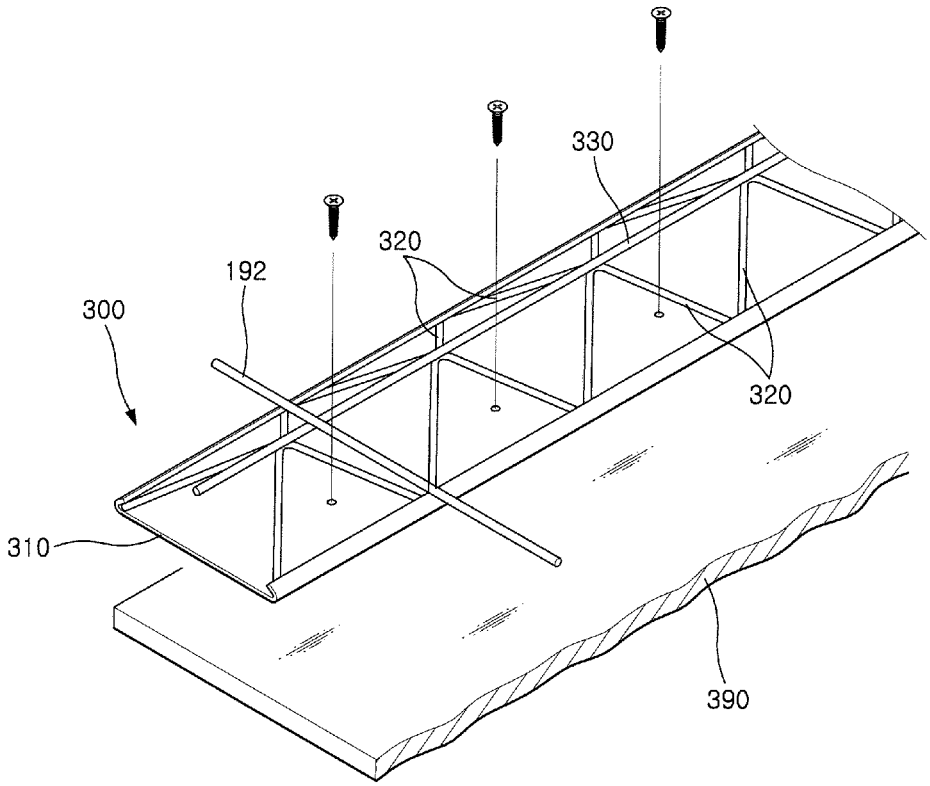
FIG. 10 is a perspective view showing a ceiling concrete form installed on a board to still another embodiment of the present invention.
Figure 11:
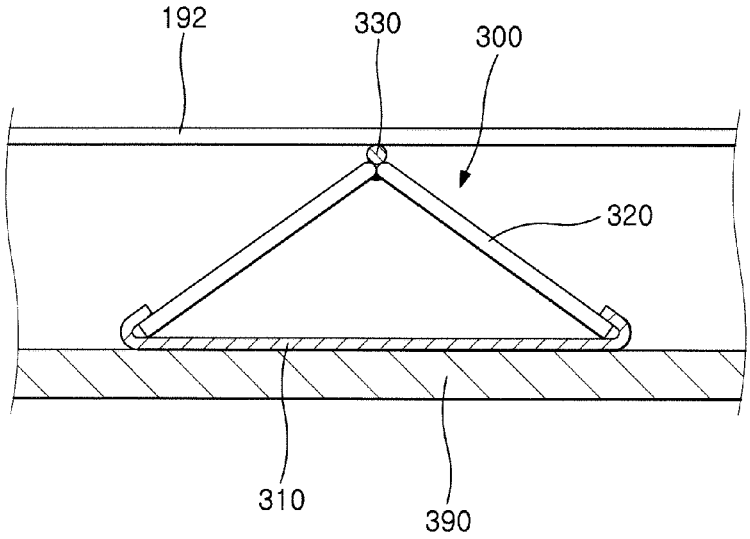
FIG. 11 is a front view showing the ceiling concrete form of FIG. 10.

FIGS. 1 and 2 shows a prefab wall 100 according to an embodiment of the invention. FIGS. 3-9 show a column concrete form 200 according to another embodiment of the invention. FIGS. 10 and 11 shows a ceiling concrete form 300 according to still another embodiment of the invention.

An aspect of the invention provides the prefab wall 100. The prefab wall 100 comprises a metal mesh portion 10, a plurality of dented line portions 20, a plurality of horizontal cut portions 30, two edge-pole portions 40, and a foam or light concrete portion 50.

Actually, in FIGS. 1 and 2, the prefab wall 100 has the upper portion exposed with the metal mesh portion 10.

The metal mesh portion 10 is formed with a shape of three-sided vertical mesh frame, and the metal mesh portion 10 comprises front net 12 and two side nets 14.

The plurality of dented line portions 20 are provided horizontally across a plurality of locations of the metal mesh portion 10 in order to stabilize the structure by introducing three-dimensional sub-structure to otherwise two-dimensional front net 12.

Each of the plurality of horizontal cut portions 30 is provided at an edge of the side nets 14 and being configured to receive one or more rebars 192.

Each of the two edge-pole portions 40 is provided vertically along an inner edge of the side nets 14 of the metal mesh portion 10 as shown in FIG. 2.

The foam or light concrete portion 50 is disposed and hardened with the metal mesh portion 10 and the plurality of dented line portions 20.

The wall 100 is configured to be adjoined with another external wall 100 by engaging through the side nets 14 by a plurality of mechanical fasteners (not shown). Actually, two or more metal mesh portions 10 are adjoined and assembled together through the plurality of mechanical fasteners fixing side nets 14 of neighboring metal mesh portions 10.

Each of the two edge-pole portions 40 may comprise a wooden angular pole as shown in FIG. 1.

Each of the two edge-pole portions 40 may be fixed to the inner edge of the side nets of the metal mesh portion 10.

The wall 100 may be adapted to be disposed leaning to and fixed to an external dry wall 190.

The metal mesh portion 10 may further comprise two extending portion 16 from the edges of the side nets 14, so as to wrap a side of the edge-pole portions 40 as shown in FIG. 2.

The prefab wall 100 may further comprise a plurality of horizontal bolstering L-shaped metal bars 60, each of which being queued through the side nets 14 at a location close to the front net 12. Each of the horizontal bolstering L-shaped metal bars 60 may be a metal tube.

The metal mesh portion 10 of the prefab wall 100 can be built one or more storied height conveniently. That way, a building wall can be done very easily floor by floor just by erecting the prefab walls 100. Of course, in order to finish the building wall, the empty spaces or gaps inside the metal mesh portions 10 and between the metal mesh portions 10 and the dry wall 190 must be filled with regular concrete. Still, considering the regular building walls constructed by laying the countless bricks or blocks one by one, it facilitates so much to erect a wall.

As shown in FIGS. 3 through 9, another aspect of the invention provides a column concrete form 200, comprising a metal mesh portion 10, a plurality of horizontal cut portions 30, four edge-pole portions 40, and a plurality of horizontal fixing groove portions 70.

The metal mesh portion 10 is formed with a shape of three-sided vertical mesh frame, basically same as in the prefab wall, and the metal mesh portion comprises a front net and two side nets, each of which meeting the front net at two bent edges.

Each of the plurality of horizontal cut portions 30 is provided at an edge of the side nets and being configured to receive one or more rebars (not shown) horizontally. Since the column concrete form 200 is going to be a form for concrete to be filled in later, one or more rebars may be disposed also vertically inside the metal mesh portion 10.

Each of the four edge-pole portions 40 is provided vertically along an inner edge of the side nets of the metal mesh portion 10 or the two bent edges. In the illustrated embodiment, one of the four is not seen, but it is there.

Figure 6:
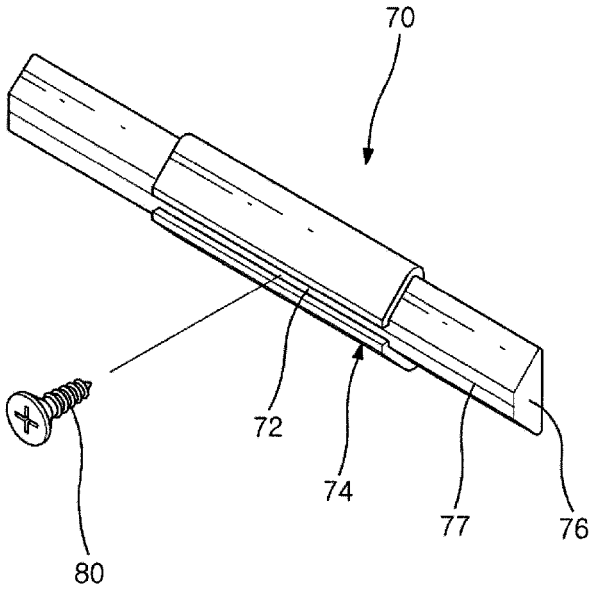
FIG. 6 is a perspective view showing a horizontal fixing groove portions according to another embodiment of the present invention.

The plurality of horizontal fixing groove portions 70 are buried in a first external concrete wall 290 horizontally, and each of the plurality of horizontal fixing groove portions 70 comprises an opening 72, a wedge-shaped gap 74, and a holding material 76 inserted through the wedge-shaped gap 74 as shown in FIG. 6. And, each of the plurality of horizontal fixing groove portions 70 is configured to fix the column or column concrete form 200 to the first external concrete wall 290 by a plurality of screws 80, each of which is applied from an inner surface of the metal mesh portion 10 to the opening 72 and the holding material 76 of the wedge-shaped gap 74 in the first external concrete wall 290 contacting an outer surface of the front net of the metal mesh portion 10.

The holding material 76 in the wedge-shaped gap 74 may be made of plastic and adapted to receive and hold the screw. In certain embodiments, the holding material 76 may be a wood or any other material having appropriate properties.

The holding material 76 in the wedge-shaped gap 76 may be provided in an elongated form, and the holding material 76 comprises an elongated slit 77 configured to guide and prevent the screw 80 from slipping away while being screwed.

Each of the plurality of horizontal fixing groove portions 70 may be made of metal.

Each of the four edge-pole portions 40 may comprise a wooden angular pole fixed to the metal mesh portion 10 with mechanical fasteners as in the prefab wall 100. The mechanical fasteners may comprise nails, screws, or wires.

Figure 4:
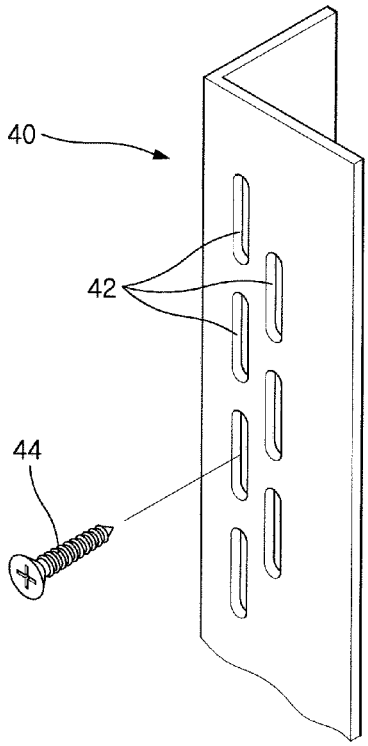
FIG. 4 is a perspective view showing an edge-pole portion of a column concrete form according to another embodiment of the present invention.
Figure 5:
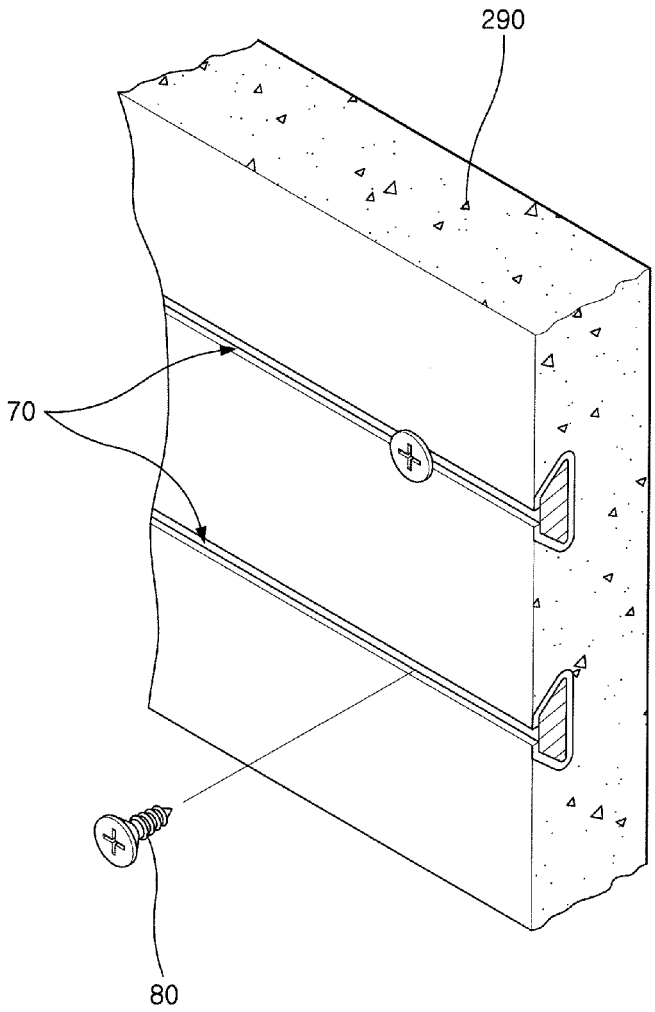
FIG. 5 is a perspective view showing two horizontal fixing groove portions embedded in a wall for fixing the column concrete form.

Alternatively, each of the four edge-pole portions 40 may comprise an L-shaped metal pole as shown in FIG. 4.

The L-shaped metal pole 40 may comprise a plurality of elongated through-holes 42 for screws 44 connecting itself to the metal mesh portions 10.

Figure 7:
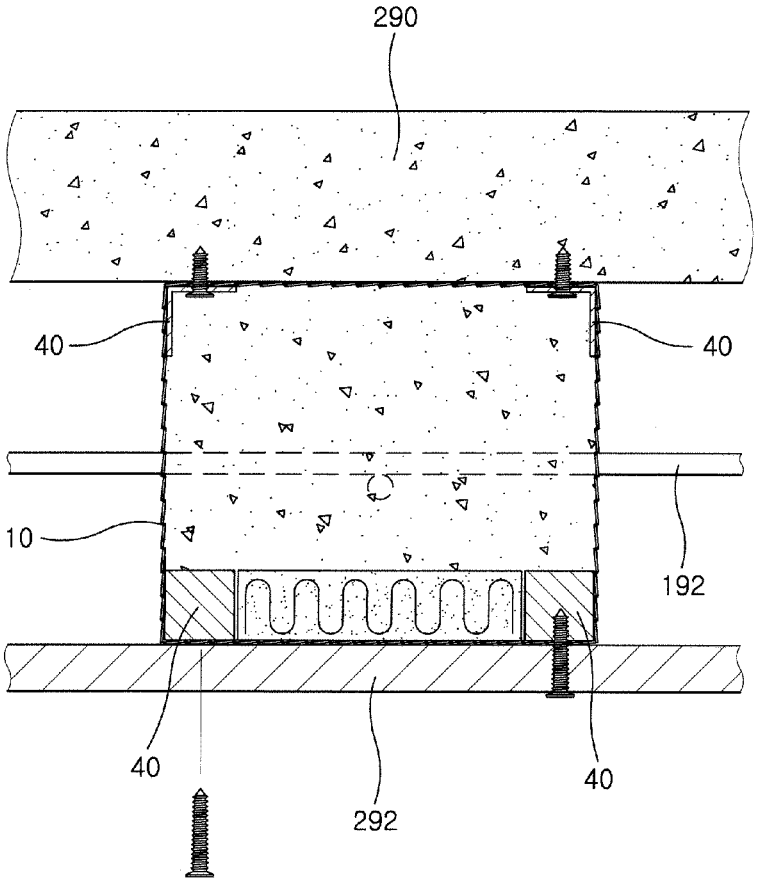
FIG. 7 is a top plan view showing a column concrete form sandwiched between two walls according to an embodiment of the present invention.
Figure 8:
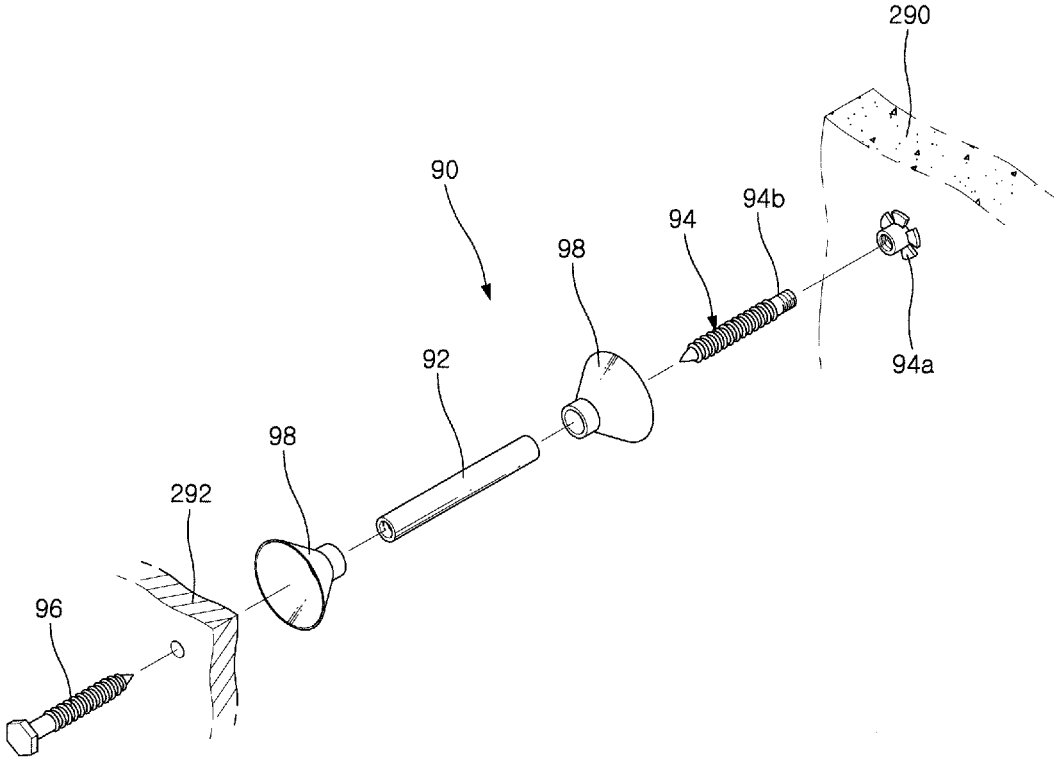
FIG. 8 is an exploded perspective view showing a wall-bolstering fastener according to still another embodiment of the present invention.
Figure 9:
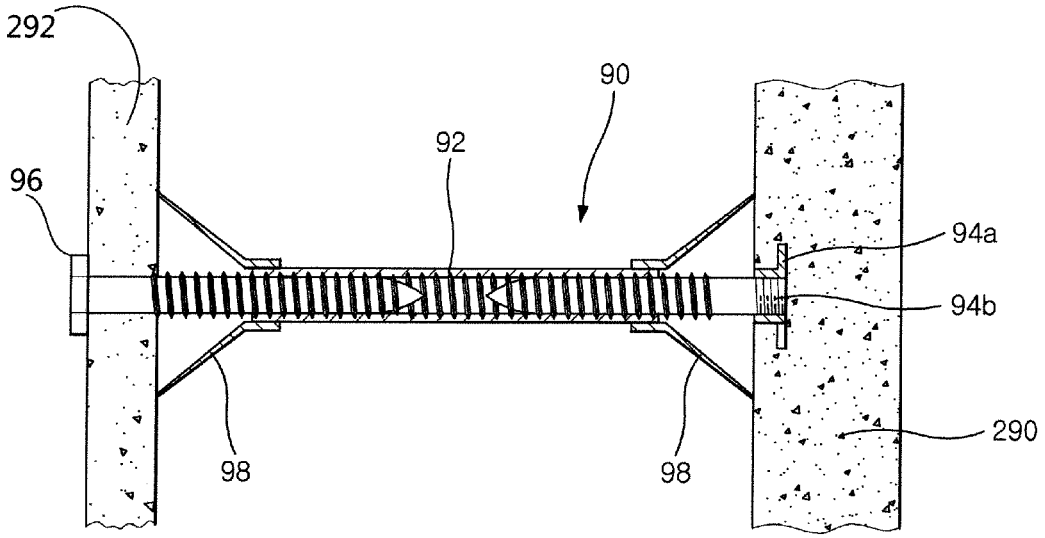
FIG. 9 is a cross-sectional view showing the wall-bolstering fastener of FIG. 8 installed between two walls according to still another embodiment of the present invention.

The column concrete form 200 may further comprise a plurality of wall-bolstering fasteners 90 for holding together and bolstering the first external wall 290 and a second external wall 292 sandwiching the column or column concrete form 200 with the first external wall 290 as shown in FIGS. 7-9.

Each of the wall-bolstering fasteners 90 may comprises a connecting tube 92, a first screw 94, a second screw 96, and two funnel portions 98.

The connecting tube 92 has a master female thread on an inner surface thereof.

The first screw 94 has a detachable screw head 94*a* buried in the first external wall 290 and a detachable screw body 94*b*, and the detachable screw head 94*a* comprises a female thread through a hole disposed therein and a plurality of catching vanes and the detachable screw body 94*b* comprises a first male thread configured to engage the female thread of the detachable screw head 94*a* and a second male thread configured to engage the master female thread of the connecting tube 92.

The second screw 96 has a fixed head and a fixed body, and the fixed body comprises a male thread configured to engage the master female thread of the connecting tube 92.

The two funnel portions 98 are disposed at both ends of the connecting tube 92, and each of the funnel portions 98 is configured to guide the first and second screws 94, 96 into the connecting tube 92. Of course, the length of the connecting tube 92 can be adjusted according to the distance between the first and second external walls 290, 292.

Each of the wall-bolstering fasteners 90 is disposed between the first and second external concrete walls 290, 292.

The second screw 96 engages the connecting tube 92 through the second external concrete wall 292.

As shown in FIGS. 10 and 11, still another aspect of the invention provides a ceiling concrete form 300, comprising an elongated metal base board 310, a plurality of pyramidal trusses 320, and a longitudinal bar 330.

The elongated metal base board 310 includes two raised edges as shown in FIGS. 10 and 11.

Each of the plurality of pyramidal trusses 320 comprises four edge bars connecting a portion of two raised edges of the elongated metal base board 310 with a pyramidal point where the four edge bars meet and engage one another securely.

The longitudinal bar 330 is disposed so as to connect all pyramidal points of the plurality of pyramidal trusses 320.

The ceiling concrete form 300 may be configured to be disposed next to another ceiling concrete form side by side and each of the ceiling concrete forms 300 is fixed detachably on an external bottom board 390, so that concrete is poured on the adjoined array of the ceiling concrete forms 300.

Of course, one or more rebars 192 may be disposed over the array of the ceiling concrete forms 300.

The invention provides a house built using the prefab walls or wall frames 100, the column concrete forms 200, and the ceiling concrete forms 300.

The light cement board may comprise grain material, sand grains, fiber material, fiber glass, cement, plastic cement, glue or gellatin, and ammonium dichromate. The grain material includes aluminum silicate grain, finely crushed bones, shells, dry stall pumice, perlite, coral, and coal ash. The fiber material includes needle-shaped straws, hemp, reeds, bamboo tree, plastic threads, and chaffs, and the fiber material processed with wood preservative and fire deterrant. The grain material, the fiber material, the fiber glass, the cement, the plastic cement, the glue, and the ammonium dichromate are mixed substantially evenly and formed into a board by pressure.

In an embodiment, the metal mesh portions 10 may be adjoined by spot-welling.

In another embodiment, the metal mesh portions 10 may be coated so as not to be oxidized.

The foam or light concrete portion 50 may be poured into a form with patterns of bricks or others, and then the metal mesh portion 10 can be immersed such that the concrete portion 50 in liquid state can be disposed and hardened around the metal mesh portion 10. That way, a concrete form for a wall can be made. Likewise, the column concrete form 200 can provide concrete forms for columns conveniently.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A building comprising:

a prefab wall concrete frame comprising:

a metal mesh portion formed with a shape of three-sided vertical mesh frame, the metal mesh portion comprising front net and two side nets;

a plurality of dented line portions provided horizontally across a plurality of locations of the metal mesh portion;

a plurality of horizontal cut portions, each of which being provided at an edge of the side nets and being configured to receive one or more rebars;

two edge-pole portions, each of which being provided vertically along an inner edge of the side nets of the metal mesh portion; and a foam or light concrete portion disposed and hardened with the metal mesh portion and the plurality of dented line portions, wherein the prefab wall concrete form is configured to be adjoined with another prefab wall concrete form by engaging through the side nets by a plurality of mechanical fasteners; and a ceiling concrete form provided on the top of the prefab wall concrete frame, the ceiling concrete form comprising:

an elongated metal base board with two raised edges;

a plurality of pyramidal trusses, each of which comprising four edge bars connecting a portion of two raised edges of the elongated metal base board with a pyramidal point where the four edge bars meet and engage one another securely; and a longitudinal bar disposed so as to connect all pyramidal points of the plurality of pyramidal trusses.

2. The building of claim 1, wherein each of the two edge-pole portions comprises a wooden angular pole.

3. The building of claim 2, wherein each of the two edge-pole portions is fixed to the inner edge of the side nets of the metal mesh portion.

4. The building of claim 1, wherein the prefab wall concrete form is adapted to be disposed leaning to and fixed to a dry wall.

5. The building of claim 1, wherein the metal mesh portion further comprise two extending portion from the edges of the side net, so as to wrap a side of the edge-pole portions.

6. The building of claim 1, further comprising a plurality of horizontal bolstering L-shaped metal bars, each of which being queued through the side nets at a location close to the front net.

7. The building of claim 1, wherein the ceiling concrete form is configured to be disposed next to another ceiling concrete form and each of the ceiling concrete forms is fixed detachably on an external bottom board, so that concrete is poured on the adjoined array of the ceiling concrete forms.

* * * * *